US006694654B2

(12) United States Patent
Poulokefalos et al.

(10) Patent No.: US 6,694,654 B2
(45) Date of Patent: Feb. 24, 2004

(54) DISPLAY TAG HOLDER

(75) Inventors: Dimitris Poulokefalos, Addison, IL (US); Nicholas Kalouris, Addison, IL (US); Vangelis Economou, Chicago, IL (US)

(73) Assignee: American Gasket Technologies, Inc., Addison, IL (US)

( * ) Notice: Subject to any disclaimer, the term of this patent is extended or adjusted under 35 U.S.C. 154(b) by 7 days.

(21) Appl. No.: 10/167,949

(22) Filed: Jun. 12, 2002

(65) Prior Publication Data

US 2003/0230018 A1 Dec. 18, 2003

(51) Int. Cl.[7] ..... G09F 3/00
(52) U.S. Cl. ..... 40/642.01; 40/657
(58) Field of Search ..... 40/642.01, 657, 40/124.01, 642.02

(56) References Cited

U.S. PATENT DOCUMENTS

| | | | | |
|---|---|---|---|---|
| 3,189,185 A | | 6/1965 | Grasso | |
| 3,483,995 A | | 12/1969 | Larson | |
| 3,912,084 A | | 10/1975 | Valiulis | |
| 4,140,224 A | | 2/1979 | Celeste | |
| 4,345,470 A | | 8/1982 | Hof et al. | |
| 4,525,944 A | | 7/1985 | Fast | |
| 4,715,135 A | | 12/1987 | Fast | |
| 4,773,172 A | | 9/1988 | Fast | |
| 4,888,897 A | * | 12/1989 | Fast | 40/657 |
| 5,088,606 A | | 2/1992 | Boas | |
| 5,123,189 A | | 6/1992 | Fast et al. | |
| 5,235,766 A | | 8/1993 | Fast et al. | |
| 5,261,175 A | | 11/1993 | Gebka | |
| 5,325,616 A | | 7/1994 | Valiulis | |
| 5,421,113 A | * | 6/1995 | Gebka et al. | 40/642.01 |
| 6,006,463 A | | 12/1999 | Mueller | |
| 6,082,687 A | | 7/2000 | Kump et al. | |
| 6,128,843 A | * | 10/2000 | Gebka | 40/642.01 |

OTHER PUBLICATIONS

Fast Industries Catalog vol. 2 entitled "The Fast Way to a Better Bottom Line" (cover page and pp. 2–12) (circa 1997).

* cited by examiner

*Primary Examiner*—Gary Hoge
(74) *Attorney, Agent, or Firm*—Vangelis Economou; Ladas & Parry

(57) ABSTRACT

A display tag holder that has a mounting portion, an intermediate portion, and a display portion. The mounting portion mounts to a merchandise display hook hanging on a wall with the intermediate portion extending above and supported by the hook so that the display portion extends downwards and forwards of the tip of the hook to display the pertinent merchandise information. The mounting portion has two wedge shaped protrusions, which fit between the hook and wall, and the intermediate portion has a raised portion, which increases the stiffness of the holder. These features help to prevent the holder from falling off the hook or hanging under the hook in the event that a customer accidentally bumps or brushes against the holder.

16 Claims, 3 Drawing Sheets

10
14
15
16
17
18
20
22
24
32
34
36
38
40
50
52
54
56
58
110
115
116
117
118
120
150
154
156
158

DISPLAY TAG HOLDER

BACKGROUND OF THE INVENTION

1. Field of the Invention

The invention relates generally to a display tag holder for merchandise suspended from a horizontally extending support hook, or the like. More particularly, the present invention relates to a display tag holder that is easily attached to and removed from a product support hook without being subject to inadvertent removal.

2. Background Art

Display tag holders are well known in the merchandising field. They are conventionally formed from a urethane or polyvinyl plastic sheet that is preferably die cut into the appropriate shape. The display tag holders normally display product information forwardly of items that are suspended from a hook extending horizontally from a vertical pegboard.

The display tag holder includes a mounting portion arranged to be temporarily deformed while being attached to and removed from the hook at a location adjacent to the pegboard, an intermediate portion which projects forwardly from the pegboard and extends over the support hook and the merchandise supported thereon, and a display portion which bends downwardly from the distal end of the intermediate portion in front of the hook so as to display the desired product information.

Known label holders are prone to lateral bending or flexing of the holder along its intermediate portion as a result of customers contacting the holder. This results in the display portion of the holder being positioned beside the suspended merchandise and not in front of it. Thus, the label holder may be displayed not in direct view of customers. Such bending or flexing can occur when a merchandise item is being removed from an adjacent hook by a customer who accidentally brushes against the holder.

In order to deal with this problem, longitudinally extending ribs or longitudinal rows of perforations along the intermediate portion have been suggested. The intent is to promote transverse flexure of the intermediate portion of the holder into a bowed configuration to reinforce the holder against longitudinal and lateral flexure. Another known product employs side wings, which are integral with and extend downwardly from the side edges or margins of the intermediate portion to impart longitudinal stiffness to the intermediate portion. The side wings are folded downwardly from the intermediate portion along longitudinally extending preformed fold lines so that the wings are located substantially perpendicular to the plane of the intermediate portion and are co-extensive in length with the intermediate portion. Other manufacturers simply use thicker sheet material for the intermediate portion in order to provide more stability and resistance to lateral bending. Use of such thicker plastic sheet material adds to the manufacturing costs and reduces the ability to deform the display tag holders to assume the desired shape.

Still another known product uses scalloping on downwardly turned edges of the intermediate portion to provide rigidity to the intermediate portion. This structure also prevents packages supported on the hook from sliding forward or backward along the hook. Another way of stabilizing the intermediate portion of the label holder on the hook, while at the same time preventing movement of articles on the hook, is by means of a tab which folds downwardly out of the intermediate portion and around the hook via at least one aperture in the tab to accommodate the hook.

It is also known to provide a slot near the forwardly distal end of the intermediate portion in order to accommodate a tip of the hook. This is to prevent both a drooping of the intermediate portion and lateral movement of the label holder in relation to the hook.

All of these devices for preventing longitudinal or lateral flexure of the intermediate portion and a drooping of the distal display end of the intermediate portion have drawbacks, or do not operate optimally.

Perforations or creases which promote transverse flexure of this strip into a bowed configuration when the strip is squeezed laterally necessitate a means for perforating or creasing the intermediate portion and an additional means for squeezing the strip laterally to produce the bowed configuration. Such perforations or creases also require additional forming steps because they cannot be injected in the initial forming step. Employing wings along the sides of the intermediate portion necessitates the use of additional material for the intermediate portion. It also necessitates a means for folding down the wings before use of the label holder so that the wings can perform their stiffening function. The provision of an aperture near the distal end of the intermediate portion to accommodate a tip of the hook does not prevent a lateral motion of the intermediate portion and only prevents further sagging of the intermediate portion.

Further, it is known to provide a hanger guard that has a series of spaced ribs extending along an intermediate portion of the guard at a location rearwardly of a bubble that enshrouds the top and sides of the tip. This guard is a one piece member molded of resiliently flexible plastic. However, such a design would need to be modified to be used as a label holder. In addition, the provision of multiple spaced ribs means that the part requires a complex mold to manufacture, or additional and unnecessary steps in the manufacturing process.

It is known to provide an intermediate portion with a raised "plateau" above a border region, which adds longitudinal stiffness to the intermediate portion. While this may improve the stiffness of the intermediate portion, the use of the plateau produces sharp edges at the corners of the different planes. While these sharp edges provide stiffness and rigidity to the structure, the rigidity of the plastic cannot accommodate transverse bending forces when these are exerted onto the front tab or on the intermediate portion. The tab portion is desirably free from any contact with the immediately adjacent hook that extends immediately below the cantilevered intermediate portion and tab of the display tag holder. Such a structure is on occasion, inadvertently jostled or depressed by customers. Although a force that causes the pivoting of the tab portion about a rear fold line does not normally damage the tag display, if that force is exerted in a lateral direction, that is in a direction parallel to the axis of the fold, or if any action causes the tab to twist about a longitudinal axis extending along the intermediate member, a stress is placed on the sharp edges of the "plateau" region, causing the plateau to warp or otherwise distend.

The above-described construction can accommodate some allowance or give without causing an irreversible change in the condition of the edges or corners. However, beyond a certain threshold point, the exertion of a force may cause the corner of the "plateau" region to buckle, and because there are no countervailing forces to bring the corners back into alignment, the display tag loses its shape and the position of the forward display tab becomes skewed from its desired position. Moreover, even if the deformed plastic is again brought into shape, because it lacks flexibility, the plastic becomes distended, and a weak point results at the distended area, whereby the weak point can again become easily deformed with a much lighter application of force. In other words, it is not possible to overcome the memory of the distention if the plastic becomes deformed. Thus, further improvements are needed to add flexibility to the intermediate section and to prevent the holder from bending and slipping from its mounting.

Accordingly, it is considered desirable to develop a new and improved label holder which would overcome these and other problems while providing better and more flexible and durable display tag holders capable of accommodating inadvertent twists and deformations.

SUMMARY OF THE INVENTION

A display tag holder for use with a forwardly extending merchandise display hook hanging from a wall removably attaches to the hook and is further held in place by also fitting between the hook and the wall. The tag holder extends above the hook and a display portion extends downwardly in front of a distal forward end of the hook to provide for a space to display merchandise information. The holder has a raised portion that provides for increased stiffness and rigidity of the holder to prevent the holder from unintentionally falling off the hook and out of view when a customer accidentally bumps into or brushes against the holder, and simultaneously provides sufficient flexibility in the holder to accommodate twisting.

The display tag holder provides for mounting with and between a forwardly extending merchandise display hook hanging on a wall, the display tag holder comprising a display portion, a mounting portion oppositely disposed along a longitudinal line of the display tag holder from the display portion, and an intermediate portion extending between the display portion and the mounting portion having a raised portion being raised from two laterally disposed longitudinally extending edges, and part of the raised portion further comprising a longitudinally extending, upwardly convex, semi-cylindrical spine with an apex.

A system for using the inventive display tag holder may include a pegboard and a hook. In another embodiment, the inventive display tag holder may comprise a mounting portion oppositely disposed along a longitudinal line of the display tag holder from the display portion, first and second apertures being spaced and configured to engage the wall or pegboard mounting portions of the merchandise display hook, and a first wedge-shaped protrusion which extends away from a forward facing surface of the mounting portion and is disposed between the first and second apertures to provide an interference fit between the merchandise display hook and the mounting portion. A second wedge-shaped protrusion may extend in the opposite direction from the opposite surface of the mounting portion.

DETAILED DESCRIPTION OF THE PREFERRED EMBODIMENTS

Figures 1, 2, 3:
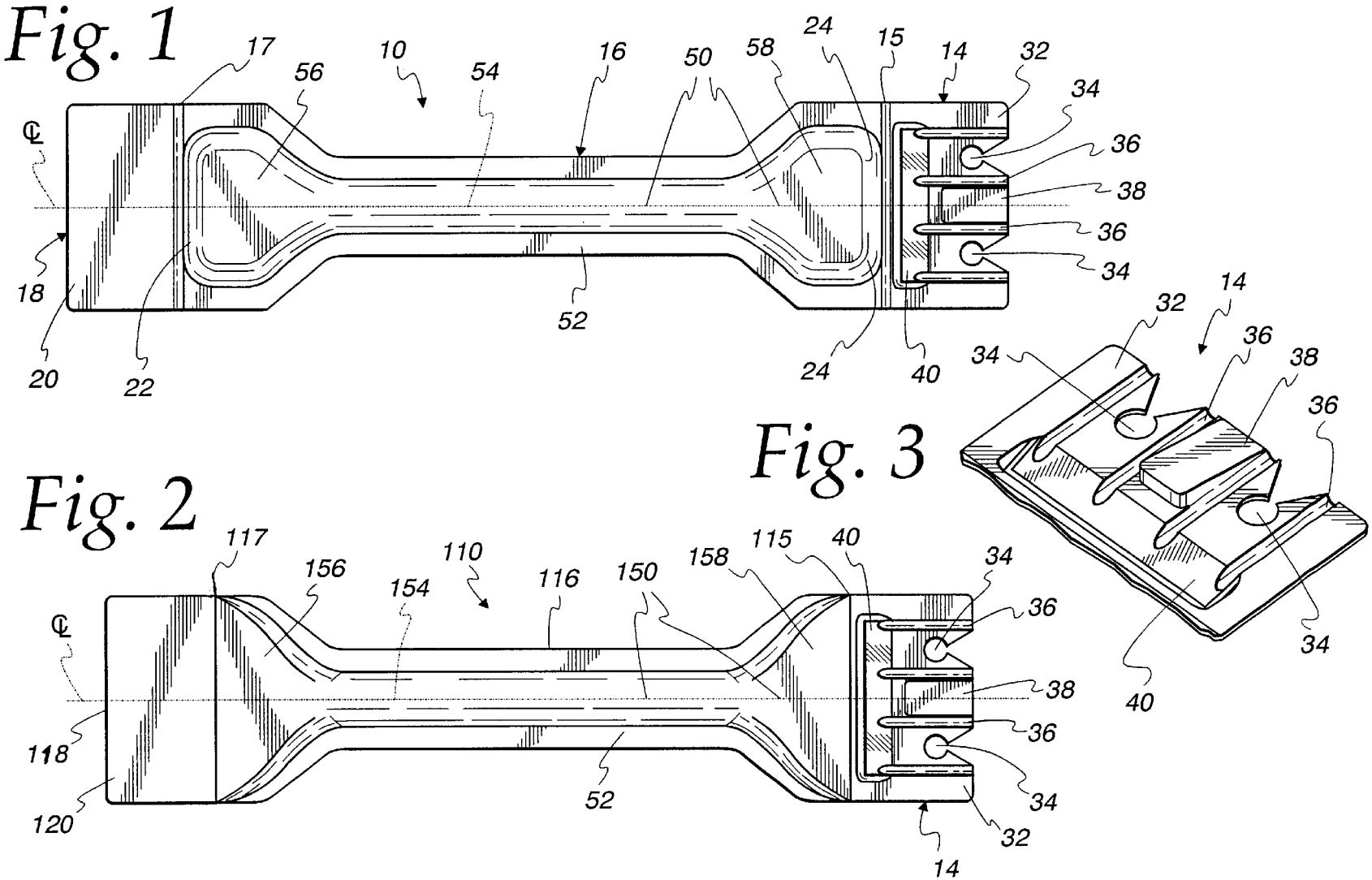
FIG. 1 is a plan view of the embodiment of the display tag holder shown in FIG. 1.
FIG. 2 is a plan view of the second embodiment of the display tag holder.
FIG. 3 is an enlarged perspective view of the mounting portion of the display tag holder according to the invention.
Figure 4:
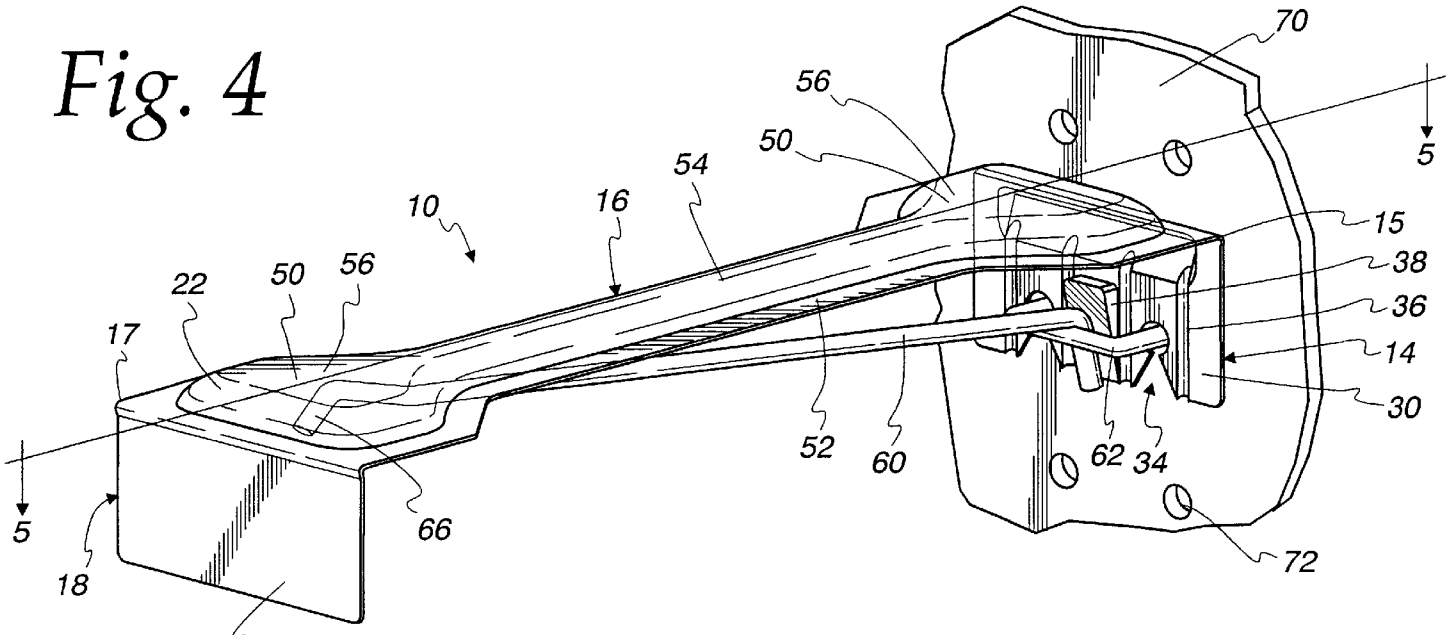
FIG. 4 is a perspective view of a first embodiment of the display tag holder shown in association with a merchandise display hook hanging on a pegboard.
Figure 5:
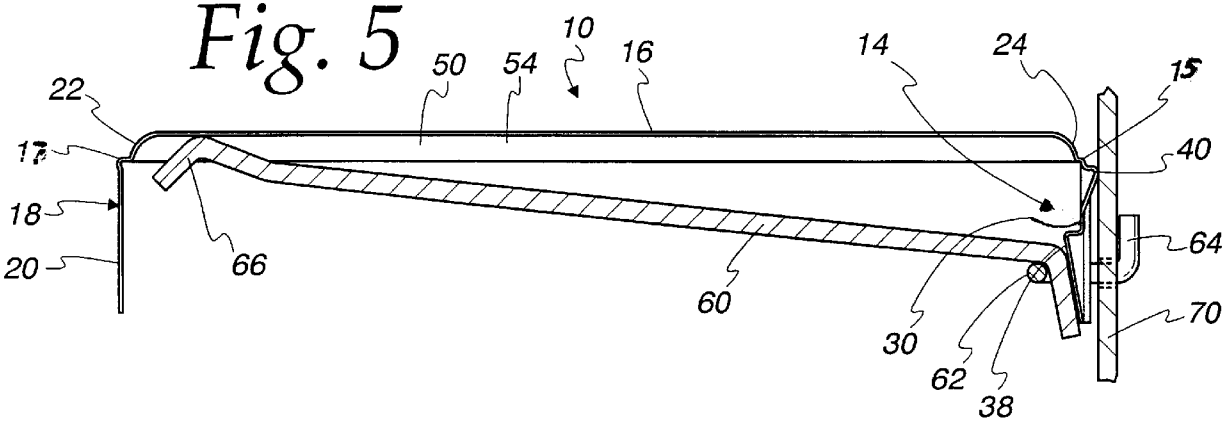
FIG. 5 is a cross-sectional side view taken approximately along the line V—V of FIG. 4.
Figure 6:
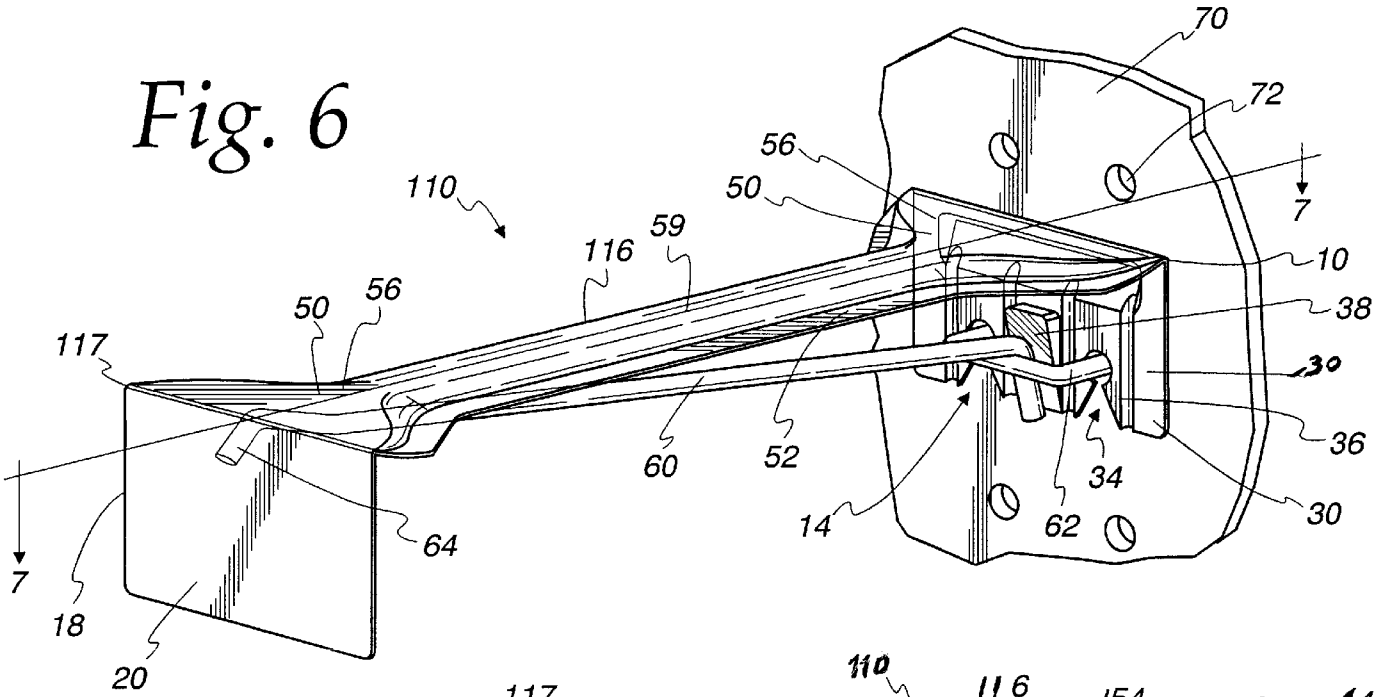
FIG. 6 is a perspective view of a second embodiment of the display tag holder shown in association with a merchandise display hook hanging on a pegboard.
Figure 7:
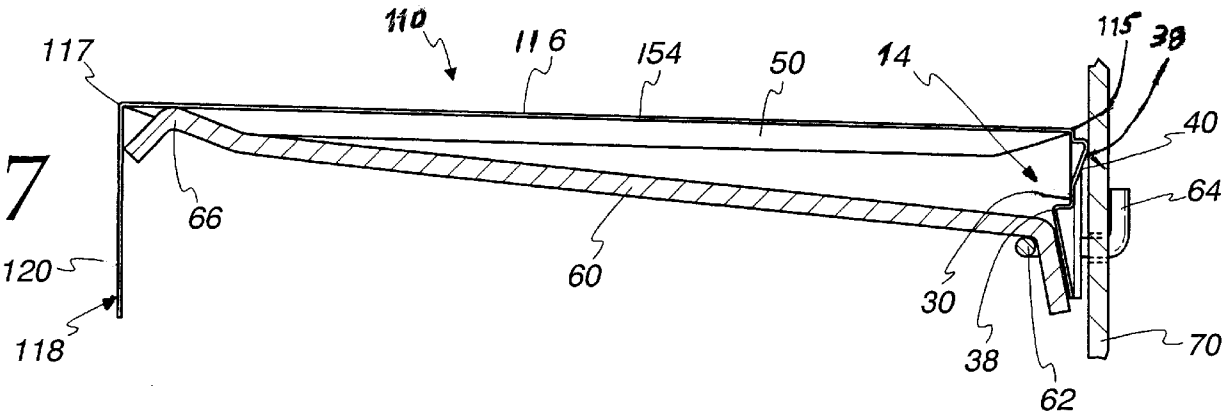
FIG. 7 is a cross-sectional side view thereof taken approximately along a line VII—VII of FIG. 6.

A first preferred embodiment of the display tag holder is shown in FIGS. 1, 4 and 5. A second preferred embodiment is shown in FIGS. 2, 6 and 7. The display tag holder 10 includes a mounting portion 14, an intermediate portion 16, and a display portion 18.

The tag holder 10 is typically manufactured from a sheet of plastic and is not injection molded. Preferably, the tag holder 10 is thermoformed by a vacuum process by which the plastic sheet is first heated until it achieves a very plastic, almost fluid state. It is easy to form it in such a fluid state, and by using known vacuum processes, the plastic sheet is then formed to produce one or more tag holders 10. Quick cooling of the sheet including tag holders 10 forms the tag holders into a final stable configuration, the sheet of tag holders 10 being removed from the mold and each tag holder 10 is cut to the desired shape, the tag holders are bundled and the bundles are delivered to the merchandiser customer.

Referring again to FIGS. 1, 4 and 5, the mounting portion 14 and intermediate portion 16 are separated by a fold line 15 and the display portion 18 and the intermediate portion 16 are separated by a fold line 17. The fold lines 15, 17 may be formed by scoring or impressing a line in the holder, or by forming an arcuate-shaped, or other similarly shaped, straight and narrow section in the display tag holder 10, which allows for the portions of the tag holder 10 to be easily bent relative to each other and deformed along those fold lines 15, 17, thereby to produce the final form as used by the customer. Ideally, the fold lines directly abut the curved, essentially vertically extending surface 22, 24, as shown, so that terminal portions of the longitudinal front ends 56 and rear end 58, respectively, of the raised portion 50 are provided, as will be described below.

The different embodiments of display tag holders 10, 110 shown in FIGS. 1 and 2 are in the manufactured state before delivery to the ultimate merchandiser or user of the tag holders. The description of the portions of the display tag holder 10 is best understood with reference to the description of the use environment, that is, use of the display tag holder 10 in conjunction with the hook 60 and pegboard 70, as is shown in FIGS. 4–7. However, the description is drawn to the display tag holders 10 and 110 without the pegboard and the hook, and the following description relates to the different elements thereof. Where necessary, use of the tag holders 10, 110 will be described with reference to the use environment, as shown in FIGS. 4–7.

Just prior to use, the holder 10 is arranged for mounting. The mounting portion 14 is bent downwards at the fold line 15, the fold line 15 connecting the mounting portion 14 to the intermediate portion 16, and similarly the display portion 18 is bent downwards at the fold line 17, the fold line 17 connecting the intermediate portion 16 and the display portion 18. In this position both the mounting portion 14 and display portion 18 are deformed to deflect downwardly and are orientated each to produce approximately a right angle relative to the intermediate portion 16. The portions are shown in the bent state during use in FIGS. 4 and 5 for tag holder 10 and in FIGS. 6 and 7 for tag holder 110.

The display portion 18 has a front surface 20, which is particularly adapted to mount adhesive labels thereon. However, the preferred embodiments shown and described are not meant to limit the shape or configuration of the display portion as any number of well-known label mounting structures and methods may be used to affix a label to the display portion 18.

The abutting configuration of the fold line 15 immediately adjacent a forwardly curved vertical surface 22, as well as fold line 17 adjacent the rearwardly curved vertical surface 24, is an important feature of the invention, because of the termination of the surfaces 22, 24 immediately at the fold lines 15, 17. The coincident termination of the surfaces 22, 24 at the fold lines 15, 17 produces more precise, rigid and durable fold lines, and further ensures that, when bent, the fold provides a perpendicular fold of the mounting portion 14 and display portion 18 relative to the center line CL of the intermediate portion 16.

It has been noted that if a planar separation is present between the fold line and the bottom termination of the vertical surface, that is, a border between the fold line and the vertical surfaces, as in certain prior art tag holders, a tendency arises for the fold to not follow exactly along the fold line. This results in an undesirable skewing of the intermediate portion position away from the perpendicular, causing the front display portion of the tag holder to end up astride the desirable position immediately ahead of the loading end 66 of the hook 60. The structure of this embodiment of tag holder 10 forces the folds, to occur essentially along the fold lines 15, 17, because the score lines are reinforced by vertically extending ends of surfaces 22, 24, which extend vertically and horizontally precisely along the fold lines and perpendicularly to the centerline CL.

The mounting portion 14 includes a display face 30 and a back surface 32. The mounting portion is shown in greater detail in FIG. 3, and is applicable to either of the two tag holder embodiments 10, 110. As shown in FIGS. 4 and 5, the tag holder 10 is in the assembled position, with the intermediate portion 16 being perpendicularly folded relative to the plane of the face 30. Two apertures 34 are provided in the mounting portion 14.

Longitudinally extending reinforcement buttresses 36 are also provided to increase the planar stiffness of the mounting portion 14. A wedge-shaped first protrusion 38, best shown in FIG. 3, extends upwardly and forwardly from the forwardly facing surface 30 of the mounting portion 14, as viewed when the tag holder is in its use environment. This first protrusion 38 is disposed between the two apertures 34 and is shown to have a top surface that diverges outwardly from the plane of surface 30 in the forward direction.

A wedge-shaped second protrusion 40 extends upwardly and rearwardly from the rearwardly facing surface 33 of the mounting portion 14. This second protrusion 40 is preferably located above the apertures 34, when the mounting portion 14 is in the vertical position, and preferably extends laterally beyond the lateral positions of the apertures 34 and across essentially most of the lateral width of the mounting portion 14.

The intermediate portion 16 extends longitudinally between the display portion 18 and the mounting portion 14 and is connected by the fold lines 15, 17. The intermediate portion 16 includes two longitudinally extending horizontal edges 52, which extend along the periphery of a raised portion 50. Ideally, the edges 52 are located laterally of the raised portion 50, and the two edges 52 may be in a planar configuration with each other.

The central section of the raised portion 50 is a longitudinally extending, upwardly convex, semi-cylindrical spine 54 that extends in the direction of the centerline CL. The longitudinal ends 56 of the raised portion 50 extend laterally so that the preferably curved ends 56, 58 are wider than the spine 54. The longitudinal ends 56, 58 also extend longitudinally to each terminate at a vertical surfaces 22, 24, respectively, so as to each directly abut against a fold line 15,17. Since end 56 is disposed immediately adjacent the mounting portion 14 and the other end 58 is immediately adjacent display portion 18, there is no longitudinally disposed border region separating the intermediate portion 16 from either the mounting portion 14 or the display portion 18. It has been noted that the absence of such a border region increases the rigidity and stiffness of holder 10 when it is in use, and will aid in deployment of the tag holder 10 in merchandising use, for example, providing a single score line abutting a raised surface for bending of the portions 14 and 18 in relation to the intermediate portion 16.

The entire periphery of the central portion of the raised portion 50, including the vertically curved end portions 56, 58, is upwardly convex. This upwardly convex shape provides for greater rigidity and stiffness of the intermediate portion 16 to inhibit bending in the vertical direction and also is configured to easily accommodate sideways lateral bending or twisting. Moreover, because of the structure, wherein the end portions 56, 58 are directly abutting the curved upwardly convex surfaces 22, 24, the rigidity of the fold lines 15, 17 in conjunction with the convex central portion 50, increases the rigidity of the intermediate portion 16 at the connection between the sections 14 and 16 and sections 16 and 18, respectively.

In the second embodiment of the holder 110, shown in FIGS. 2, 6 and 7, the lateral edges 152 slope upwards adjacent the ends 156 of the raised portion 150, to meet with the fold lines 115, 117. In this embodiment, the apex of the spine 154 forms a horizontally extending axis, and the fold lines 115, 117 lie on the same horizontal plane as this horizontally extending axis. That is, the fold lines 115, 117 lie in the highest surface apex of the semi-cylindrical spine 154.

In an optional modification of this embodiment, not shown in any of the drawings, the rounded spine end portions do not remain at the level of the highest apex of spine 154, but slope downwardly from the spine toward the fold lines to meet the mounting and front display portions in a plane below the apex, as viewed in an installed condition in a merchandising use.

As shown in FIGS. 4–7, the tag holders 10, 110 are used in association with a merchandise display hook 60 hanging on a pegboard 70. The wall 70 is preferably an aperture board, also known as a pegboard, having a plurality of evenly spaced apart holes 72 extending therethrough, usually formed in a grid pattern.

The display hook 60 preferably has a wall mounting portion 62, which generally comprises two, usually tubular extensions that are bent in the upward direction on an extension removed from a merchandise loading end 66. The extensions are shaped and configured to extend through two adjacent ones of the holes 72 in the pegboard 70 to secure the wall mounting portion 62 to the pegboard 70. The display hook 60 extends horizontally from the wall mounting portion 62 into the pegboard, and terminates at a tip section 64 that is upwardly oriented behind the pegboard to provide the attachment that holds the hook 60 in place. At the opposite, distal end of the hook 60 is the conventional upwardly convex, loading end 66, which is shaped to impede merchandise from falling off the hook 60.

It will be appreciated by those having skill in the art that there are many varieties of known display hooks and support structures other than a pegboard with which the tag holders 10,110 may be used by modifying or altering the construction, such as changing the shape, dimensions and configuration for the holders 10,110, while still practicing the inventive features of the present invention. For example, one possible modified version of the tag holder embodiment shown in FIGS. 6 and 7 is described above.

The use of the holder now will be described, utilizing the example of a tag holder 10 in FIGS. 4 and 5. However, the use is equally as applicable to other embodiments, such as tag holder 110. The mounting portion 14 and display portion 18 are bent downwards at the fold lines 15,17 in respect to the intermediate portion 16, as previously discussed above. The mounting portion is then inserted from above the wall mounting portion 62 and between the pegboard 70 and the wall mounting portion 62 of a display hook 60, mounted on the pegboard 70, so that the apertures 34 of the mounting portion 14 provide an interference fit around the mounting portions 62.

As the mounting portion 14 is inserted to receive the wall mounting portion 62, the first wedge-shaped protrusion 38 wedges in against the display hook 60, providing for an interference fit between the display hook 60 and the pegboard 70. Also, as the mounting portion 14 is inserted into the wall mounting portion 62, the second wedge-shaped protrusion 40 simultaneously presses against the pegboard 70, providing a further interference fit of the mounting portion 14 between the display hook 60 and the wall 70. To provide further frictional interference against the pegboard 70, it is preferable that a lateral edge of the protrusion 40 closest to the intermediate portion 16 itself also be directly abutting the fold line 15. Thus the fold line 15 merges with the curved surface of the protrusion 40, best seen in cross-section in FIG. 5, causes an additional measure of rigidity to the structure so as to increase the frictional contact thereof.

The interference fit of the mounting portion 14, and the shape of apertures 34, allows for the holder to be mounted and removed from the display hook 60, without requiring the removal of the hook 60 from the pegboard 70. In an ideal structure and configuration, the operation of the apertures 34, the wedge-shaped protrusion 38, second protrusion 40 and the reinforcement buttresses 36 together act on surface 30 to produce slight contortions in the plastic of the mounting portion 14 so as to increase the frictional forces and of the interference fit and between the protrusions 38, 40 butting against the wall mounting portion 62 and the pegboard 70, respectively. The interference fit thus produced maintains the holder 10 in position and inhibits it from being accidentally and unintentionally jostled or otherwise displaced, such as in the event a customer bumps into or brushes against the holder 10.

When properly mounted, and when the folds 15, 17 are rendered perpendicularly to the centerline CL, the display portion 18 of the tag holder is folded downwardly and is disposed immediately before the distal end 66 of the hook 60, with the end 66 being essentially centrally located in the horizontal direction of display 20.

The raised portion 50 of the intermediate portion 16, as discussed above, provides rigidity or stiffness to the holder 10,110. One purpose of providing this rigidity or stiffness is to prevent the intermediate portion 16, which is supported by the tip section 66 of the display hook 60, from falling off the display hook 60, and thereby positioning the display portion 18 beside the merchandise suspended from the display hook 60, and thereby become disassociated from the merchandise (not shown) mounted on the hook 60. The raised portion 50 provides enough rigidity or stiffness in the intermediate portion 16 so that, if a customer accidentally bumps or brushes against the mounted holder 10, the holder will be retained in its preferred position with the display portion 18 positioned forward of the distal loading tip section 66 of the display hook 60 and adjacent the merchandise.

Moreover, the upwardly convex configuration of the spine 54 is flexible enough and can accommodate displacements and sidewise flexures without becoming distended and causing permanent disconfigurations to the display tag holders such that they do not properly provide their intended function. It is clearly demonstrable that a curved semi-cylindrical surface can be twisted without permanently deforming or distending the plastic material, and can be used to produce flexibility such that the central portion 50 can return to its memory shape after such a twisting motion. In contradistinction, a sharp edged flat upper surface would not provide such flexibility, and would cause deformation of the plastic sharp edges if the display portion is twisted to the same degree.

The end 58 of the raised portion 50 adjacent the display portion 18 provides for added protection against the intermediate portion 16 to deter the tag holders 10 from falling off the display hook 60. The raised portion 50 is downwardly concave and the tip section 66 of the display hook 60, which supports the intermediate portion 16, rests within the inside concave lower surface of the raised portion 50. In the event that the holder 10 is accidentally bumped or brushed by a customer, the concave lower surface of the raised portion helps to retain the intermediate portion 16 on the display hook 60.

The present invention has been described with reference to the preferred embodiments. However, the scope of the present invention is intended to include any modifications, alterations or equivalents. For example, the length of the intermediate portion 16, 116 has been shown to be of a specified dimension, but persons having experience in the field will understand that both the length and the relative width of the intermediate portions may be modified to accommodate different size hooks. Thus the scope of the invention is not to be considered limited by the described embodiments but is limited only by the following claims and their equivalents.

What is claimed is:

1. A display tag holder mounted in association with and between a forwardly extending merchandise display hook hanging on a wall, the display tag holder comprising:

a display portion;

a mounting portion oppositely disposed along a longitudinal line of the display tag holder from said display portion; and an intermediate portion extending between said display and said mounting portions and having a raised portion being raised from two laterally disposed longitudinally extending edges, and at least part of said raised portion further comprising a longitudinally extending, upwardly convex, semi-cylindrical spine having an apex, wherein said raised portion is disposed immediately adjacent to said mounting portion and said display portion, said mounting portion and said display portion each being separated from said intermediate portion by a laterally extending fold line.

2. The display tag holder of claim 1, wherein said raised portion is upwardly convex along its entire length.

3. The display tag holder of claim 2, wherein said lateral edges extend through a common plane and adjacent the longitudinal ends of said semi-cylindrical spine slope upwards to meet said fold lines in a common line adjacent the apex of said spine.

4. The display tag holder of claim 3, wherein said apex of said apex of said spine lies on a longitudinally extending axis and said laterally extending fold lines are disposed on the same horizontal plane as said longitudinally extending axis.

5. The display tag holder of claim 1, wherein said mounting portion comprises:

a first aperture;

a second aperture, said first and second aperture being spaced and configured to receive wall hook portions of said merchandise display hook;

a wedge-shaped first protrusion which extends upwards and forwards from a forward facing surface of said mounting portion and is disposed between said first and second apertures; and a wedge-shaped second protrusion which extends upwards and rearwards from a rearward facing surface of said mounting portion.

6. The display tag holder of claim 5, wherein said mounting portion further comprises at least one reinforcing buttress extending longitudinally along said mounting portion.

7. The display tag holder of claim 1, wherein said holder is manufactured from plastic.

8. A display tag holder, mounted in association with and between a forwardly extending merchandise display hook hanging on a wall, the display tag holder comprising:

a display portion;

a mounting portion oppositely disposed along a longitudinal line of the display tag holder from said display portion; and an intermediate portion extending between said display and said mounting portions and having a raised portion being raised from two laterally disposed longitudinally extending edges, and at least part of said raised portion further comprising a longitudinally extending, upwardly convex, semi-cylindrical spine having an apex, wherein said raised portion is wider at its longitudinal ends than at said spine.

9. A display assembly comprising:

a wall;

a forwardly extending merchandise display hook, said hook including a wall hook portion which is mounted to said wall; and a display tag holder comprising:

a display portion;

a mounting portion oppositely disposed along a longitudinal line of the display tag holder from said display portion; and an intermediate portion extending between said display portion and said mounting portion having a raised portion being raised from two longitudinally extending planar edges, and at least part of said raised portion further comprising a longitudinally extending, upwardly convex, semi-cylindrical spine, wherein said raised portion is disposed immediately adjacent to said mounting portion and said display portion, said mounting portion and said display portion each being separated from said intermediate portion only by a laterally extending fold line.

10. The display assembly of claim 9, wherein said raised portion is upwardly convex along its entire length.

11. The display assembly of claim 10, wherein said lateral edges slope adjacent the longitudinal ends of said raised portion slope upwards to meet said fold lines.

12. The display assembly of claim 11, wherein the apex of said spine lies on a longitudinally extending axis and said laterally extending fold lines each have an axis that is coincident with said longitudinally extending axis of said spine.

13. The display assembly of claim 9, wherein said raised portion is relatively wider on its longitudinal ends and relatively narrower at said spine.

14. A display tag holder mounted in association with and between a forwardly extending merchandise display hook hanging on a vertical pegboard surface having a plurality of pegboard apertures, the merchandise display hook having a wall mounting portion for insertion into the pegboard apertures, and the display tag holder comprising:

a display portion;

a mounting portion oppositely disposed along a longitudinal line of the display tag holder from said display portion; and an intermediate portion extending between said display and said mounting portions and having a raised portion raised from two laterally disposed longitudinally extending edges, wherein said mounting portion further comprises:

first and second apertures, said first and second apertures being spaced and configured to engage said wall mounting portions of said merchandise display hook; and a first wedge-shaped first protrusion which extends away from a forward facing surface of said mounting portion and disposed between said first and second apertures to provide an interference fit between said merchandise display hook and said mounting portion; and a second wedge-shaped protrusion which extends away from a rearward-facing surface of said mounting portion to provide interference fit between the pegboard surface and said mounting portion.

15. The display assembly of claim 14, wherein said mounting portion further comprises at least one reinforcing buttress extending longitudinally along said mounting portion.

16. The display assembly of claim 15, wherein said first wedge-shaped first protrusion extends longitudinally between two adjacent reinforcing buttresses.

* * * * *